United States Patent [19]

Heft

[11] 4,281,303

[45] Jul. 28, 1981

[54] INDIVIDUAL CIRCUIT BREAKER POLE TRIP MECHANISM

[75] Inventor: Eldon B. Heft, West Hartford, Conn.

[73] Assignee: General Electric Company, New York, N.Y.

[21] Appl. No.: 128,982

[22] Filed: Mar. 10, 1980

[51] Int. Cl.[3] ..... H01H 77/10

[52] U.S. Cl. ..... 335/16; 335/195; 335/174; 335/38

[58] Field of Search ..... 335/16, 195, 38, 174, 335/175

[56] References Cited

U.S. PATENT DOCUMENTS

| | | | |
|---|---|---|---|
| 3,154,657 | 10/1964 | Bonnefois | 335/16 |
| 3,192,344 | 6/1965 | Cole | 335/16 |
| 3,464,038 | 8/1969 | Murai et al. | 335/16 |
| 4,227,161 | 10/1980 | Yamat et al. | 335/16 |

*Primary Examiner*—Harold Broome

*Attorney, Agent, or Firm*—Robert A. Cahill; Walter C. Bernkopf; Philip L. Schlamp

[57] ABSTRACT

The common trip mechanism of a multi-pole circuit breaker is supplemented by individual breaker pole trip mechanisms operating independently of each other in response to fault current flowing in its breaker pole to unlatch the movable contact arm operating therein for uninhibited, independent opening movement from its closed circuit position to a tripped open position motivated by the electrodynamic forces associated with its breaker pole fault current.

10 Claims, 2 Drawing Figures

INDIVIDUAL CIRCUIT BREAKER POLE TRIP MECHANISM

BACKGROUND OF THE INVENTION

The present invention relates to automatic electric circuit breakers, and particularly to circuit breakers having high fault current interrupting capacities.

Manufacturers of automatic electric circuit breakers are increasingly being faced with the task of developing new circuit breaker designs and upgrading existing circuit breaker designs to achieve higher current interrupting capacities in order to cope with the ever increasing current availables posed by modern applications. That is, due to the updating of electrical utility equipment, the magnitude of current available to feed a circuit fault has increased significantly, and it becomes the task of the circuit breaker protecting the faulted circuit to safely interrupt this higher fault current. Thus, the interrupting capacity of a circuit breaker has become a most critical performance parameter.

The most direct approach to achieving increased interrupting capacity is to provide a fast acting circuit breaker. That is, a circuit breaker will have an easier interrupting task if it is capable of effecting contact separation early in a fault current wavefront and thereby begin developing an arc voltage in opposition to the fault current driving voltage before the fault current achieves its prospective peak. This is due to the fact that such early development of an arc voltage is effective in cresting the fault current at actual peak amplitude which is less than its prospective peak amplitude. Equally important is the circuit breaker's ability to not only sustain this arc voltage, i.e., prevent contact reclosure, but to rapidly increase the arc voltage to a level in excess of the driving voltage so as to drive the fault current to a premature zero. Typically, the requisite rapid rise in the arc voltage is jointly achieved by rapidly increasing contact separation and by providing requisite arc handling means in the form of arc runners and arc chutes to further lengthen the arc, chop the arc into a series of arclets, and cool the arc. If the arc handling means achieves an arc quench while retaining sufficient dielectric strength to prevent restrike, a successful interruption is effected.

It is accordingly an object of the present invention to provide an automatic electric circuit breaker having increased interrupting capacity.

A further object is to provide an exceptionally fast acting circuit breaker of the above character.

Another object is to provide a circuit breaker of the above character wherein early contact separation is achieved automatically in response to a fault current.

Yet another object is to provide a circuit breaker of the above character wherein early contact separation is achieved independently of and unencumbered by the circuit breaker contact operating mechanism.

A still further object is to provide a circuit breaker of the above character wherein contact separation is motivated by the electrodynamic forces associated with the fault current.

Another object is to provide a circuit breaker of the above character having improved arc handling capabilities.

Still another object of the present invention is to provide a circuit breaker of the above character which is efficient in construction and reliable in operation.

Other objects of the invention will in part be obvious and in part appear hereinafter.

SUMMARY OF THE INVENTION

In accordance with the present invention, there is provided an exceptionally fast acting circuit breaker which incorporates a separate trip mechanism in each breaker pole operating in response to the phase current flowing therein to initiate contact separation independently of the other breaker poles and unencumbered by the breaker movable contact operating mechanism common to all the breaker poles. More specifically, a movable contact arm in each breaker pole is latched against pivotal movement relative to its carrier. The carriers of all breaker poles are commonly pivotally mounted by an insulative crossbar for concerted pivotal movement between open and closed positions by the articulation of the breaker movable contact operating mechanism between open and closed conditions, respectively. The movable contact arms in the various breaker poles carry movable contacts which engage respective stationary contacts when the arms are commonly propelled to closed circuit positions by the articulation of the breaker operating mechanism to its closed condition. A common trip mechanism latchingly sustains the closed condition of the operating mechanism until such time as an abnormal overcurrent condition is manifested by the phase current in any one of the breaker poles. In such case, the common trip mechanism trips the breaker operating mechanism which then articulates to its open condition, in the process propelling the movable contact arms to open circuit positions with the movable contacts in disengaged relation to their respective stationary contacts.

In accordance with the present invention, the individual breaker pole trip mechanisms operate independently to unlatch its associated movable contact arm from its carrier in response to a fault current flowing in its breaker pole. The unlatched arm is thus free to pivot in an opening direction from its closed circuit position to a tripped open position; such opening movement being motivated by the electrodynamic forces associated with the fault current itself. Consequently, contact separation is achieved earlier since there is no waiting for the common trip mechanism to respond to the fault current and trip the breaker operating mechanism which then acts to propel the movable arms in all the breaker poles to their open circuit positions. Moreover, when a movable arm is unlatched from its carrier by a breaker pole trip mechanism, its abrupt movement to its tripped open position is unimpeded by the breaker operating mechanism.

The individual breaker pole trip mechanism operates magnetically to unlatch its associated movable contact arm in direct response to fault current flowing through its breaker pole. Thus a separate magnetic field piece, inductively coupled with each breaker pole circuit, attracts an associated armature from a quiescent, latching position to an actuated, unlatching position to free the associated movable arm for propulsion to its tripped open position by the fault current. Springs acting on the arms resist rebounding, thus preventing the arms from bouncing back to their closed circuit positions. The followup articulation of the breaker operating mechanism from its closed to its open condition, upon being tripped by the common trip mechanism, is utilized to automatically relatch the tripped movable arms to their respective carriers.

In accordance with a feature of the present invention, the tripped open positions of the movable arms are distinct from their open circuit positions; the former positions providing more steeply pitched angular inclinations of the current paths therethrough calculated to achieve more pronounced bowing of the arc paths between the stationary and movable contacts. This serves to increase the lengths of the arc paths, move the arc footpoints of the stationary contacts, and promote capture of the arcs by the arc chutes, all effective in achieving rapid increases in the arc voltages. To further enhance arc elongation and capture by the arc chutes, the stationary contacts are fed via reverse loop current paths. The braids conducting currents from the movable contact arms are also in reverse loop configurations and are physically connected to the arms in a manner that the conduction of fault currents causes the braids to straighten, thereby exerting torques on the arms in their directions of opening movement.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawing, in which:

FIG. 1 is a side elevational view, partially broken away, of a circuit breaker embodying the present invention; and FIG. 2 is a side elevational view partially broken away, of the breaker pole trip mechanism of the present invention.

Corresponding reference numerals refer to like parts throughout the several views of the drawing.

DETAILED DESCRIPTION

Figure 1:
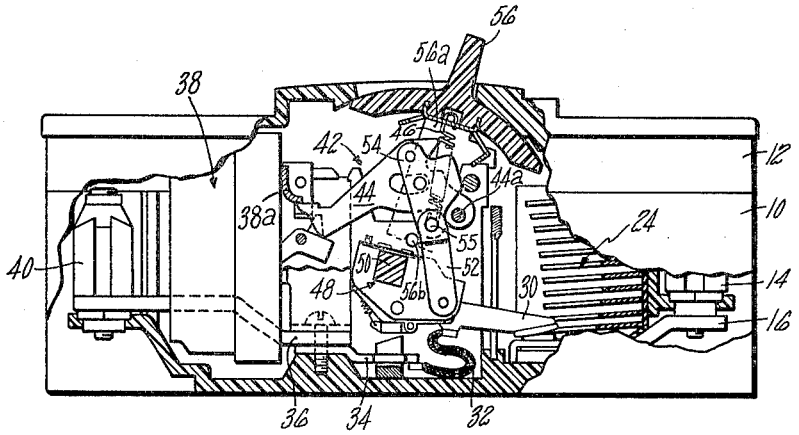
Figure 2:
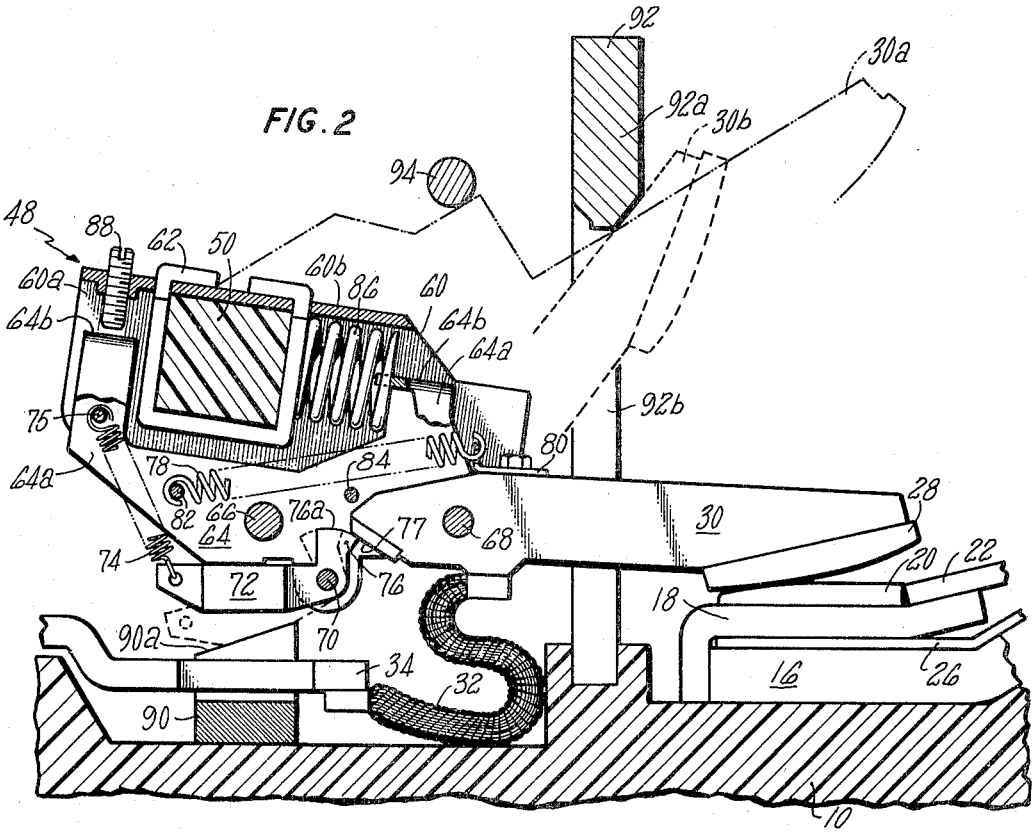

In FIG. 1 of the drawing there is illustrated a molded case industrial circuit breaker of the general construction disclosed in Klein, et al. U.S. Pat. No. 3,155,803 and in which the present invention is incorporated to achieve increased current interrupting capacity. The disclosure of this patent is specifically incorporated herein by reference. Thus, the circuit breaker includes a molded case, consisting of a base 10 and a cover 12, for housing multiple breaker poles, for example, three breaker poles in parallel, side-by-side relation. Each breaker pole includes an externally accessible line terminal 14 secured in electrical connection with the outer end portion of a line strap 16 supported on the floor of base 10. As best seen in FIG. 2, the inner end termination of this line strap is welded in electrical connection with a secondary line strap 18 configured to double back in closely spaced relation with the upper surface of line strap 16. Fixed to the upper surface of this secondary line strap is a stationary contact 20. The terminal portion of the secondary line strap beyond the stationary contact is angled upwardly and serves to mount in cantilever fashion a steel arc runner 22 extending angularly upwardly into underlying relation with a vertically stacked array of steel arc plates included in an arc chute, generally indicated at 24 in FIG. 1. An insulative sheet member 26 is situated between the line straps 16 and 18 to insure that the current feeding stationary contact 20 follows a reverse current loop path. As is understood in the art, routing of current to a stationary contact over a reverse current loop path has the beneficial effect of promoting movement of an arc footpoint off of the stationary contact and out along the arc runner, thus minimizing arc erosion of the stationary contact and promoting arc capture by the arc chute.

Stationary contact 20 is engaged by a movable contact 28 carried by the free end of a movable contact arm 30. Current flowing through this arm is conducted by a braid 32 to a strap 34. The left end of this strap, as seen in FIG. 1, is bolted in electrical connection with the inner end of a load strap 36 which extends through a common trip mechanism, generally indicated at 38, to a load lug 40. The common trip mechanism may be of the contruction shown in Klein, et al. U.S. Pat. No. 3,162,739.

The movable contact arms 30 in each of the breaker poles are commonly swung between a solid line closed circuit position with the stationary and movable contacts in each breaker pole in engaged relation and a phantom line open circuit position **30*a*, seen in FIG. 2, by a breaker operating mechanism, generally indicated at 42 in FIG. 1. This operating mechanism includes a cradle 44 which is pivotally mounted by a pin 44*a* supported by the mechanism frame. The cradle is biased in a clockwise direction by mechanism springs 46, however the cradle is normally releaseably held in its illustrated reset position by a latch 38*a* included with common trip mechanism 38. The movable contact arms 30 in the various breaker poles are supported by individual carrier assemblies, generally indicated at 48 and to be described in detail in conjunction with FIG. 2. These carrier assemblies are ganged together by a cross bar 50** rotatably mounted within the breaker case.

Interconnecting the movable contact arms with the breaker operating mechanism is a toggle linkage consisting of a lower link 52 pivotally connected at its lower end to one of the carrier assemblies 48, typically the center pole carrier assembly, and an upper link 54 pivotally connected at its upper end to cradle 44. The other ends of these two links are pivotally interconnected by a knee pin 55 to which the lower ends of mechanism springs 46 are hooked. The toggle linkage is articulated between collapsed and straightened conditions, pursuant to swinging the contact arms 30 between their open and closed circuit positions, by means of a manually operating handle 56. This handle is carried by a generally U-shaped handle support **56*a* whose lower ends are pivotally mounted by pivot pins 56*b* carried by the mechanism frame. The upper ends of the mechanism springs 46 are hooked to the bight portion of handle support 56*a*. As is more fully described in the above-noted U.S. Pat. No. 3,156,803, pivotal movement of handle 56 from its rightmost ON position and its leftmost OFF position seen in FIG. 1, swings the line of action of the mechanism springs to the left of the line of centers of the toggle linkage pivot pins, causing the toggle linkage to collapse leftwardly from its illustrated straightened condition. The mechanism springs, in discharging to collapse the toggle linkage, exert a counterclockwise torque on the ganged carrier assemblies 48, causing the movable arms 30 to swing in concert about the axis of cross bar 50 from their closed circuit positions to their open circuit positions 30*a*, seen in FIG. 2. To then reclose the breaker, handle 56 is pivoted back to its ON position, in the process swinging the line of action of the mechanism springs to the right of the pivotal connection of upper toggle link 54 with cradle 44**. The toggle linkage is thus straightened, driving the movable contact arms back to their closed circuit positions.

If the current flowing in any one of the breaker poles rises to an abnormal overcurrent level, common trip mechanism 38 responds in a manner to cause its latch 38*a* to release cradle 40, thereby tripping the breaker operating mechanism. The mechanism springs discharge to swing cradle 44 in the clockwise direction about its pivot 44*a*, at the same time swinging the straightened toggle linkage in the clockwise direction about its lower pivotal connection with the center pole carrier assembly 48. When the pivotal connection of the toggle linkage with cradle 44 swings through the line of action of mechanism springs 46, the toggle linkage is collapsed by the discharge of these springs. With toggle collapse, the arms 30 are swung in the opening direction from their closed circuit position to their open circuit position 30*a* seen in FIG. 2. To return the operating mechanism to its reset condition, handle 56 is pivoted to its OFF position which is effective in swinging cradle back into latching engagement with latch 38*a*. At this point, the breaker contacts can be reclosed by pivoting handle 56 back to its ON position.

Turning to FIG. 2, carrier assembly 48 in each breaker pole includes an outer carrier member 60 of generally U-shaped configuration having opposed sides 60*a* depending from an interconnecting bight 60*b*. Aligned rectangular openings in outer carrier sides 60*a* accommodate the extension therethrough of cross bar 50. The outer carrier is fixedly secured to the cross bar by a staple 62. Nested within this outer carrier is an inner carrier member 64, also of U-shaped configuration having depending sides 64*a* interconnected by separate, forward and rear bight portions 64*b*. A transverse pin 66 supported by the outer carrier sides 60*a* serves to pivotally mount inner carrier 64. A transverse pin 68 supported by inner carrier sides 64*a* serves to pivotally mount movable contact arm 30 adjacent its left end. Also supported by the inner carrier sides 64*a* is a transverse pin 70 which serves to mount a magnetic armature 72. A tension spring 74, hooked at its lower end to the free end of armature 72 and at its upper end on a pin 75 carried by the inner carrier sides 64*a*, biases armature 72 in the clockwise direction about pivot pin 70 to a quiescent position abutting the bottom edges of inner carrier sides 64*a*. Integrally formed with armature 72 is a latch element 76 having an arcuate latching surface 76*a* which latchingly engages a flat latching surface 77 formed at the left end of movable arm 30. It is thus seen that while armature 72 is in its solid line, quiescent position, these latching surfaces are in engagement to lock arm 30 against counter-clockwise pivotal movement about pin 68 under the bias of a tension spring 78 hooked at one end to a bracket 80 affixed to the upper edge of the movable arm and at its other end on a pin 82 mounted between inner carrier sides 64*a*. A transverse pin 84 is mounted between the inner carrier sides to serve as a stop preventing clockwise rotation of arm 30 about its pivot pin 68. Under these circumstances, it is seen that arm 30 is essentially locked against pivotal movement with respect to inner carrier 64. A compression spring 86 acting between staple 62 securing outer carrier 60 to cross bar 50 and the forward bight portion 64*b* of inner carrier 64 exerts a clockwise torque on the inner carrier calculated to provide the requisite contact pressure between stationary contact 20 and movable contact 28 when arm 30 is swung to its solid line, closed circuit position by the breaker operating mechanism. A set screw 88 threaded through bight 60*b* of the outer carrier serves as an adjustable stop for the rearward bight portion 64*b* of the inner carrier to thus limit the degree of clockwise angular displacement of the inner carrier with respect to the outer carrier induced by spring 86 and thereby establish a permissible contact wear allowance.

To induce unlatching of movable contact arm 30, a U-shaped magnetic field piece 90 is supported by the floor of base 10 in embracing relation with strap 34 to present a pair of pole faces 90*a* in closely spaced relation to armature 72. It is seen that when a fault current flows through strap 34, the flux induced in field piece 90 creates a magnetic field exerting a magnetic attraction on armature 72, causing it to be pivoted to its phantom line, actuated position seen in FIG. 2. Latch 76 is thus swung in the counter-clockwise direction, disengaging latch surfaces 76*a*, 77, and freeing movable contact arm 30 for counter-clockwise, opening pivotal movement about its pivot pin 68. It will be noted that when the movable arm is unlatched or tripped, all contact engagement pressure is removed and the movable contact is literally blown away from the stationary contact by the electrodynamic forces associated with the fault current flowing therebetween. Arm 30 is thus forcefully and rapidly propelled about its pivot pin 68 to a tripped open position illustrated in phantom at 30*b*. It will be noted that braid 32, connected between arm 30 and strap 34, is arranged in serpentine fashion so as to provide a reverse current loop. The interaction of the electrodynamic forces associated with currents flowing in opposite directions along closely spaced parallel path segments causes braid 30 to straighten, in the process exerting a counter-clockwise torque on arm 30 aiding its opening movement when unlatched by armature 72. The opening movement of arm 30, as motivated by the fault current itself, is so swift that spring 78 cannot react swiftly enough to be of assistance. However, this spring does serve to prevent significant rebounding of the arm from its tripped open position 30*b* back toward its closed circuit position.

It is seen that the arm's tripped open position is established by its abutment with the bight portion 92*a* of a barrier 92 spanning the width of the breaker molded case to separate the arc chambers of each breaker pole from the breaker operating mechanism. Thus, this barrier is in the configuration of a comb having depending barrier segments 92*b* straddling the movable arms 30 operating in the breaker poles. It is noted that the tripped open position 30*b* of the movable arm is distinct from its open circuit position 30*a*, by virtue of the fact that, in assuming its tripped open position, the arm is pivoted about pivot pin 68 while, in assuming its open circuit position, the arm is swung about the axis of cross bar 50. The increased inclination of the arm in its tripped open position 30*b* as compared to its open circuit position, has the beneficial effect of causing increased outward bowing of the arc drawn between the separating movable and stationary contacts. This is seen from the fact that the angle between the current path through the arm and the line of separation of the contacts (a straight line extending between the separated contacts) is less when the arm assumes its tripped open position rather than its open circuit position. This creates a more closely coupled reverse current loop to enhance the interaction of the magnetic fields associated with the arc current and the current flowing in the movable arm; such enhanced interaction producing electrodynamic forces acting to create more pronounced bulging or bowing of the arc path in the direction of the arc chute. Increased elongation of the arc path is achieved, in the process bringing the arc into proximity with the arc chute plates where it is captured, broken up and cooled.

The fault current responsible for tripping an individual movable arm will also cause common trip mechanism 38 to trip breaker operating mechanism 42. Thus, with the release of cradle 44, carrier assemblies 48 will be commonly pivoted to their open position seen in phantom in FIG. 2, as established abutment with a fixed stop 94. Since the tripped movable arm or arms will already have assumed their tripped open positions 30*b* as the carrier assemblies are swung to their open positions, barrier 92 is effective in camming the tripped arms in the clockwise direction about their pivot pins 68. By this time during a fault current interruption, the magnetic attraction exerted on armature 72 by the field piece will have diminished sufficiently to enable spring 46 to return the armature to its quiescent, latching position. As the carrier assemblies arrive at their open positions, the tripped movable arms will have cammed sufficiently in the clockwise direction to swing their rearward edges upwardly, deflecting their latch elements 76 out of the way in order that the arm latching surfaces 77 be lifted above the swing of the armature latching surfaces 76*a*. Springs 74 instantly restore the armatures to their latching positions to bring their latching surfaces 76*a* back into engagement with arm latching surfaces 77, thereby relocking the arms against pivotal movement about their pivot pins 68. It is thus seen that the tripped movable arms are reset or relatched incident with the culmination of tripping articulation of the breaker operating mechanism, i.e., when the carrier assemblies 48 assume their open positions in abutment with stop 94.

As evidence of the speed at which the individual breaker pole trip mechanisms operate in response to a fault current, short circuit tests indicate that contact separation can be achieved as early as 0.58 milliseconds after the onset of a fault current fed by a 50,000 ampere available source. At lower fault current availables, the magnetic response of the breaker pole trip mechanism is naturally somewhat slower, for example, contact separation in 1.9 milliseconds in the case of a 10,000 ampere available fault current. In contrast, initial contact separation achievable by the common trip mechanism acting via the breaker operating mechanism is in the neighborhood of 5 milliseconds, in the case of a 10,000 ampere available fault current. Thus, by virtue of the present invention, the time required to effect contact separation during a fault current interruption is reduced dramatically. Consequently, an arc voltage is developed that much sooner to act in opposition to the fault current driving voltage. The extremely rapid opening movement of the movable contact arms coupled with the more pronounced outward bowing of the arc path, accelerates the elongation of the arc path to promote rapid development of increasing arc voltage. This action also promotes an earlier capture of the arc in the arc chute 24, thereby driving the arc voltage abruptly higher yet to a level in excess of the system driving voltage, whereupon the fault current is crested at amplitude well below its prospective peak and then driven to a premature zero. The achievement of a fault current interruption in this manner dramatically reduces the magnitude of the energy that the circuit breaker must absorb, and thus its interruption task is made that much easier. The interrupting capacity of the circuit breaker is therefore increased, making it applicable to circuits supplied from higher current available sources.

It is understood that for overload and low level fault currents, circuit interruption will be initiated by the common trip unit 38. The individual breaker pole trip mechanisms may be provided with response characteristics such that for fault currents in excess of 3,000 to 4,000 amperes, the movable arms are tripped open directly. More specifically, the response characteristics of the individual breaker pole trip mechanisms may be coordinated with those of the common trip mechanism such as to only respond to fault currents of magnitudes in excess of three times the current magnitude required to actuate the common trip mechanism within one-half cycle, or approximately 8 milliseconds.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawing shall be interpreted as illustrative and not in a limiting sense.

Having described my invention, what I claim as new and desire to secure by Letters Patent is:

1. A circuit breaker having a spring-powered operating mechanism manually operable between open and closed conditions, a trip mechanism responsive to an over-current condition for tripping the operating mechanism to initiate automatic conversion of same from its closed condition to its open condition, and at least one breaker pole comprising, in combination:

A. carrier means coupled with the operating mechanism and mounted for pivotal movement between open and closed positions as the operating mechanism articulates between its open and closed conditions, respectively;

B. an elongated, conductive arm pivotally mounted adjacent one end by said carrier means at a location displaced from the pivotal mounting location of said carrier means;

C. a movable contact carried by said arm adjacent the other end thereof.

D. a stationary contact;

E. a magnetic field piece inductively coupled with the current flowing through the breaker pole;

F. an armature mounted for movement from a quiescent position to an actuated position under the magnetic attraction of said field piece as developed by fault current flowing through the breaker pole;

G. a first latch surface carried by said arm at a location beyond said arm pivotal mounting location from said movable contact;

H. a second latch surface carried by said armature for latching engagement with said first latch surface with said armature in its quiescent position to latch said arm against pivotal movement relative to said carrier means, whereby said arm is pivoted between a closed circuit position where said movable contact engages said stationary contact and an open circuit position in concert with the pivotal movement of said carrier means between its closed and open positions, respectively, said latching surfaces disengaging upon attraction of said armature to its actuated position to free said arm for independent, uninhibited pivotal movement motivated by the flow of fault current from its closed circuit position to a tripped open position distinct from its open circuit position, the angle of the current path in said arm in its tripped open position relative to the line of separation of said contacts being more acute than when said arm is in its open circuit position.

2. The circuit breakers defined in claim 1, wherein said breaker pole further includes a stop against which said arm abuts upon assuming its tripped open position, said stop causing said arm to swing about its pivotal mounting as said carrier means is pivoted from its closed position to its open position with the articulation of the operating mechanism from its closed condition to its open condition in response to being tripped by the trip mechanism, whereby said arm is converted from its tripped open position to its open circuit position incident to effecting automatic latching re-engagement of said first and second latch surfaces.

3. The circuit breaker defined in claim 2, wherein said carrier means includes a first carrier pivotally mounted to the circuit breaker and a second carrier pivotally mounted to said first carrier, said arm being pivotally mounted to said second carrier.

4. The circuit breaker defined in claim 3, wherein said carrier means further includes a tension spring acting to bias said arm away from its closed circuit position.

5. The circuit breaker defined in claim 4, wherein said carrier means further includes a compression spring acting between said first and second carriers to exert a force on said arm in its closed circuit position providing requisite contact pressure.

6. The circuit breaker defined in claim 3, wherein said armature is pivotally mounted to said second carrier and spring biased to its quiescent position.

7. The circuit breaker defined in claim 1, wherein said breaker pole further includes a flexible braid electrically interconnecting said arm with a load strap, said braid being arranged in serpentine fashion to provide a reverse current loop path, upon the flow of fault current through said braid, said braid exerting a torque on said arm aiding pivotal movement thereof from its closed circuit position to its tripped open position.

8. The circuit breaker defined in claim 7, wherein said breaker pole further includes a line strap configured to feed current to said stationary contact via a reverse current loop path.

9. The circuit breaker defined in claim 1, 2, 7 or 8 having multiple breaker poles and an insulative rotatably mounted crossbar to which said carrier means in each said breaker pole is fixedly secured.

10. The circuit breaker defined in claim 3, 4, 5 or 6 having multiple breaker poles and an insulative, rotatably mounted cross bar to which said first carrier in each said breaker pole is fixedly secured.

* * * * *